US010008158B2

(12) United States Patent
Park et al.

(10) Patent No.: US 10,008,158 B2
(45) Date of Patent: Jun. 26, 2018

(54) DISPLAY DEVICE USING ADJUSTABLE GAMMA VOLTAGE

(71) Applicant: SAMSUNG DISPLAY CO., LTD., Yongin-si, Gyeonggi-do (KR)

(72) Inventors: Jin Woo Park, Yongin-si (KR); Dong Hwan Kim, Yongin-si (KR); Ki Myeong Eom, Yongin-si (KR)

(73) Assignee: SAMSUNG DISPLAY CO., LTD., Yongin, Gyeonggi-do (KR)

( * ) Notice: Subject to any disclaimer, the term of this patent is extended or adjusted under 35 U.S.C. 154(b) by 27 days.

(21) Appl. No.: 15/199,107

(22) Filed: Jun. 30, 2016

(65) Prior Publication Data

US 2016/0314747 A1 Oct. 27, 2016

Related U.S. Application Data

(63) Continuation of application No. 13/958,907, filed on Aug. 5, 2013, now Pat. No. 9,384,699.

(30) Foreign Application Priority Data

Jan. 15, 2013 (KR) ..... 10-2013-0004490

(51) Int. Cl.

| | |
|---|---|
| ***G09G 3/3233*** | (2016.01) |
| ***G09G 3/3266*** | (2016.01) |
| ***G09G 3/3291*** | (2016.01) |

(52) U.S. Cl.

CPC ..... *G09G 3/3291* (2013.01); *G09G 3/3233* (2013.01); *G09G 3/3266* (2013.01); *G09G 2300/0809* (2013.01); *G09G 2300/0861* (2013.01); *G09G 2310/027* (2013.01); *G09G 2310/0283* (2013.01)

(58) Field of Classification Search

None

See application file for complete search history.

(56) References Cited

U.S. PATENT DOCUMENTS

| | | | | |
|---|---|---|---|---|
| 5,489,918 | A * | 2/1996 | Mosier | G09G 3/2011 345/101 |
| 7,301,520 | B2 * | 11/2007 | Koyama | G09G 3/30 345/100 |
| 2007/0024541 | A1 | 2/2007 | Ryu et al. | |
| 2007/0040774 | A1 | 2/2007 | Lee et al. | |
| 2007/0080910 | A1 | 4/2007 | Park et al. | |
| 2008/0012811 | A1 | 1/2008 | Sung et al. | |

(Continued)

FOREIGN PATENT DOCUMENTS

| | | |
|---|---|---|
| KR | 10-2004-0049727 A | 6/2004 |
| KR | 10-2006-0010912 A | 2/2006 |

(Continued)

*Primary Examiner* — Kent Chang
*Assistant Examiner* — Benjamin Morales Fernande
(74) *Attorney, Agent, or Firm* — Lee & Morse P.C.

(57) ABSTRACT

An organic light-emitting display device includes an organic light-emitting display panel displaying an image that includes a plurality of frames, a data driver providing a plurality of data signals, which correspond to the image, to the organic light-emitting display panel, and a gamma voltage generator providing a gamma voltage, which varies in a same period as each of the frames, to the data driver.

10 Claims, 12 Drawing Sheets

(56) References Cited

U.S. PATENT DOCUMENTS

| | | | | |
|---|---|---|---|---|
| 2008/0024692 | A1* | 1/2008 | Choi | G09G 3/3677 349/54 |
| 2009/0160880 | A1 | 6/2009 | Park et al. | |
| 2009/0201231 | A1 | 8/2009 | Takahara et al. | |
| 2010/0225511 | A1 | 9/2010 | Nishimura | |
| 2010/0321362 | A1 | 12/2010 | Weng | |
| 2011/0018846 | A1* | 1/2011 | Hu | G02F 1/136286 345/204 |
| 2011/0050740 | A1 | 3/2011 | Lee | |
| 2011/0057913 | A1 | 3/2011 | Chung | |
| 2011/0096107 | A1 | 4/2011 | Tai et al. | |
| 2011/0148841 | A1 | 6/2011 | Yeo et al. | |
| 2011/0187693 | A1 | 8/2011 | Chung | |
| 2013/0083083 | A1 | 4/2013 | Woo et al. | |
| 2013/0083087 | A1 | 4/2013 | Byun et al. | |

FOREIGN PATENT DOCUMENTS

| | | | |
|---|---|---|---|
| KR | 10-2012-0108445 | A | 10/2012 |
| KR | 10-2012-0112034 | A | 10/2012 |

* cited by examiner

DISPLAY DEVICE USING ADJUSTABLE GAMMA VOLTAGE

CROSS-REFERENCE TO RELATED APPLICATIONS

This is a continuation application based on pending application Ser. No. 13/958,907, filed Aug. 5, 2013, the entire contents of which is hereby incorporated by reference.

This application claims priority under 35 U.S.C. § 119 to Korean Patent Application No. 10-2013-0004490, filed on Jan. 15, 2013 in the Korean Intellectual Property Office, the disclosure of which is incorporated herein by reference in its entirety.

BACKGROUND

1. Field

Embodiments relate to an organic light-emitting display device.

2. Description of the Related Art

As portable display devices (such as notebooks, mobile phones, and portable media players (PMPs)), as well as display devices for homes (such as TVs and monitors), become lighter and thinner, various flat panel display devices are being widely used. There are various types of flat panel display devices including liquid crystal display (LCD) devices, organic light-emitting display devices, and electrophoretic display devices. Of the various types of flat panel display devices, organic light-emitting display devices consume low power, may provide high luminance and high contrast ratio, and may be easily implemented as flexible displays. Accordingly, the demand for organic light-emitting display devices is increasing.

An organic light-emitting display device may include an organic light-emitting display panel, which includes a plurality of pixels. Each of the pixels includes an organic light-emitting diode (OLED), which is a light-emitting element. The OLED emits light at a luminance level corresponding to an electric current flowing through the OLED. The organic light-emitting display device may display an image by adjusting the gray level of each OLED by controlling an electric current flowing through each OLED.

SUMMARY

Embodiments are directed to an organic light-emitting display device, including an organic light-emitting display panel displaying an image that includes a plurality of frames, a data driver providing a plurality of data signals, which correspond to the image, to the organic light-emitting display panel, and a gamma voltage generator providing a gamma voltage, which varies in a same period as each of the frames, to the data driver.

The display device may further include a power supply providing a first power supply voltage and a second power supply voltage, the second power supply voltage being lower than the first power supply voltage, to the organic light-emitting display panel. The organic light-emitting display panel may include first through n-th scan lines that are parallel to each other and arranged sequentially. The first power supply voltage may be provided to the organic light-emitting display panel from a side adjacent to the n-th scan line.

The display device may further include a scan driver providing a scan signal that includes a scan-on section and a scan-off section to the scan lines. The scan-on section may be applied sequentially to the scan lines in order of a scan line located closest to the side from which the first power voltage is provided to a scan line located farthest from the side from which the first power voltage is provided. The gamma voltage may gradually decrease within one frame.

The display device may further include a scan driver providing a scan signal that includes a scan-on section and a scan-off section to the scan lines. The scan-on section may be applied sequentially to the scan lines in order of a scan line located farthest from the side from which the first power voltage is provided to the scan line located closest to the side from which the first power voltage is provided. The gamma voltage may gradually increase within one frame.

The gamma voltage generator may include a gamma reference voltage generator generating a gamma reference voltage that varies in a same period as each of the frames, and a gamma voltage divider generating the gamma voltage from the gamma reference voltage.

The gamma reference voltage generator may generate the gamma reference voltage from a primitive gamma reference voltage that varies in the same period as each of the frames.

The gamma reference voltage may include first through k-th gamma reference voltages arranged in order of highest to lowest electric potential. The primitive gamma reference voltage may have a same electric potential as the first gamma reference voltage.

The gamma voltage may vary continuously within one period.

The gamma voltage may vary in a stepped manner within one period.

The display device may further include a scan driver providing a scan signal that includes a scan-on section and a scan-off section, to the organic light-emitting display panel, and the gamma voltage may not vary in the scan-on section.

Embodiments are also directed to an organic light-emitting display device including an organic light-emitting display panel displaying an image that includes a plurality of frames, a data driver providing a plurality of data signals, which correspond to the image, to the organic light-emitting display panel, a scan driver providing a plurality of scan signals to the organic light-emitting display panel in synchronization with a vertical synchronization signal, and a gamma voltage generator providing a gamma voltage that varies in synchronization with the vertical synchronization signal.

The display device may further include a power supply providing a first power supply voltage and a second power supply voltage, the second power supply voltage being lower than the first power supply voltage, to the organic light-emitting display panel. The organic light-emitting display panel may include first through n-th scan lines placed parallel to each other and arranged sequentially. The first power supply voltage may be provided to the organic light-emitting display panel from a side adjacent to the n-th scan line.

The display device may further include a scan driver providing a scan signal that includes a scan-on section and a scan-off section to the scan lines. The scan-on section may be applied sequentially to the scan lines in order of a scan line located closest to the side from which the first power voltage is provided to a scan line located farthest from the side from which the first power voltage is provided. The gamma voltage may gradually decreases within one period.

The display device may further include a scan driver providing a scan signal that includes a scan-on section and a scan-off section to the scan lines. The scan-on section may be applied sequentially to the scan lines in order of a scan line located farthest from the side from which the first power voltage is provided to a scan line located closest to the side from which the first power voltage is provided. The gamma voltage may gradually increase within one period.

The gamma voltage generator may include a gamma reference voltage generator generating a gamma reference voltage that varies in synchronization with the vertical synchronization signal, and a gamma voltage divider generating the gamma voltage from the gamma reference voltage.

The gamma reference voltage generator may generate the gamma reference voltage from a primitive gamma reference voltage that varies in synchronization with the vertical synchronization signal.

The gamma reference voltage may include first through k-th gamma reference voltages arranged in order of highest to lowest electric potential, wherein the primitive gamma reference voltage has a same electric potential as the first gamma reference voltage.

The gamma voltage may vary continuously within one period.

The gamma voltage may vary in a stepped manner within one period.

The display device may further include a scan driver providing a scan signal that includes a scan-on section and a scan-off section to the organic light-emitting display panel. The gamma voltage may not vary in the scan-on section.

BRIEF DESCRIPTION OF THE DRAWINGS

Features will become apparent to those of ordinary skill in the art by describing in detail exemplary embodiments with reference to the attached drawings in which.

DETAILED DESCRIPTION

Figure 1:
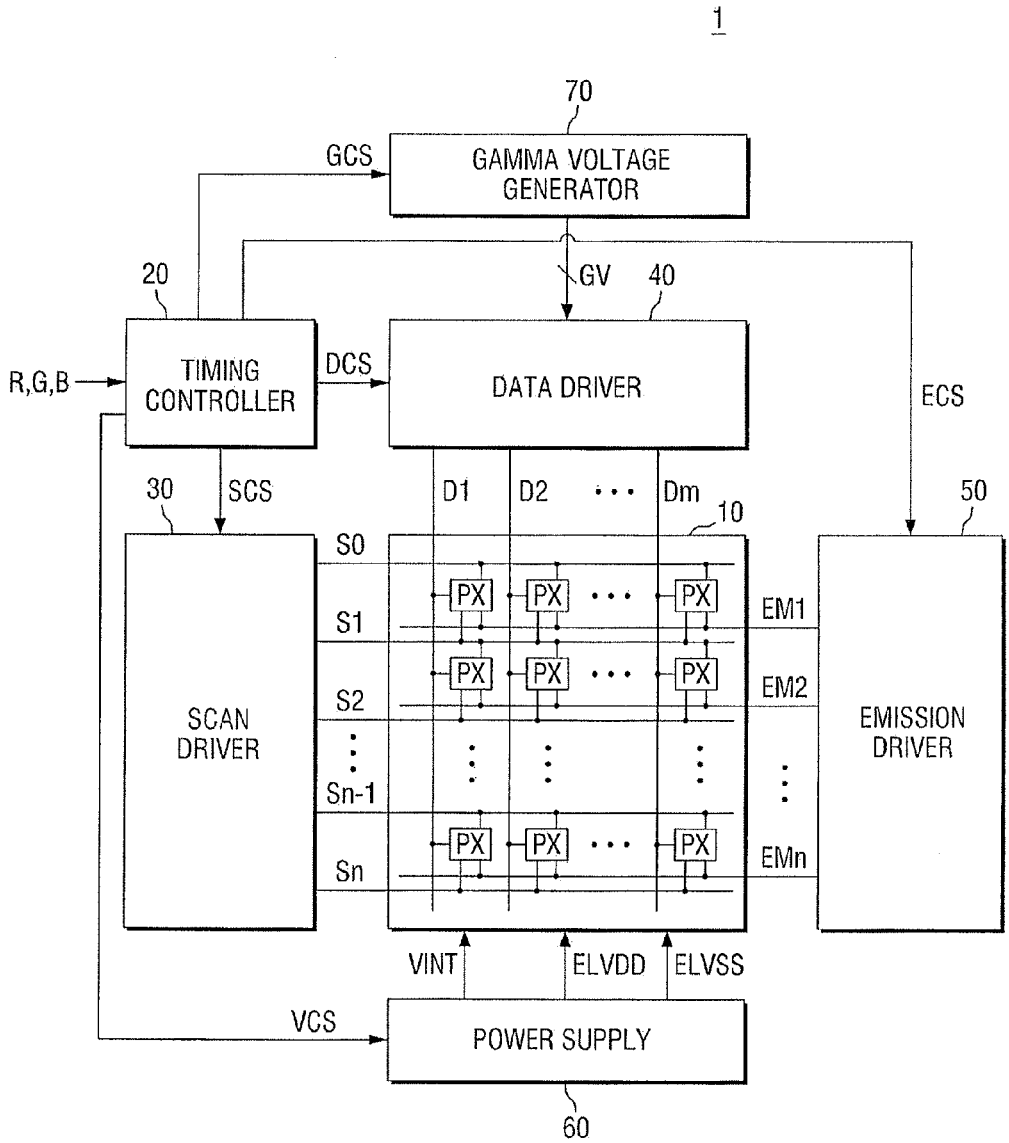
FIG. 1 is a block diagram of an organic light-emitting display device according to an embodiment.

Embodiments may be understood more readily by reference to the following detailed description of preferred embodiments and the accompanying drawings. These, however, be embodied in many different forms and should not be construed as being limited to the embodiments set forth herein. Rather, these embodiments are provided so that this disclosure will be thorough and complete and will fully convey the concept thereof to those skilled in the art, as defined more fully by the appended claims. Like numbers refer to like elements throughout. In the drawings, the thickness of layers and regions are exaggerated for clarity.

It will be understood that, although the terms first, second, etc. may be used herein to describe various elements, these elements should not be limited by these terms. These terms are only used to distinguish one element from another element. Thus, for example, a first element, a first component, or a first section discussed below could be termed a second element, a second component, or a second section without departing from the teachings.

FIG. 1 is a block diagram of an organic light-emitting display device 1 according to an embodiment.

Referring to FIG. 1, the organic light-emitting display device 1 includes an organic light-emitting display panel 10, a data driver 40, and a gamma voltage generator 70.

The organic light-emitting display panel 10 may display an image including a plurality of frames. The organic light-emitting display panel 10 may include a plurality of pixels PX and display an image by controlling light emission of an organic light-emitting diode included in each of the pixels PX. The organic light-emitting display panel 10 may receive a first power supply voltage ELVDD, a second power supply voltage ELVSS, an initialization voltage VINT, $zero^{th}$ through $n^{th}$ scan signals S0 through Sn, first through $m^{th}$ data signals D1 through Dm, and first through $n^{th}$ emission control signals EM1 through EMn from external sources and operate the pixels PX according to the received signals. The operation of the pixels PX will be described in detail below with reference to FIG. 2.

The first power supply voltage ELVDD may be provided to the organic light-emitting display panel 10 from a side of the organic light-emitting display panel 10. For example, the organic light-emitting display panel 10 may include $zero^{th}$ through $n^{th}$ scan lines to which the $zero^{th}$ through $n^{th}$ scan signals S0 through Sn are respectively transmitted and which are arranged substantially parallel to each other. In this case, the first power supply voltage ELVDD may be provided to the organic light-emitting display panel 10 from a region adjacent to the $n^{th}$ scan line.

Although not shown in the drawing, the organic light-emitting display panel 10 may include wiring for delivering the first power supply voltage ELVDD. The wiring may have internal resistance. The first power supply voltage ELVDD may drop due to the internal resistance of the wiring. Therefore, as a distance from a side of the organic light-emitting display panel 10 from which the first power supply voltage ELVDD is provided increases, the first power supply voltage ELVDD in the organic light-emitting display panel 10 may decrease due to the internal resistance of the wiring. For example, the first power supply voltage ELVDD may be higher in a region adjacent to the $n^{th}$ scan line than in a region adjacent to the $zero^{th}$ scan line in which the internal resistance of the wiring has a great influence on a voltage drop. If the first power supply voltage ELVDD has a different value in each region of the organic light-emitting display panel 10 due to the internal resistance of the wiring, display quality may be reduced. More specifically, for the same gray level, a region with a low first power supply voltage ELVDD may display a low luminance level compared to a region with a high first power supply voltage ELVDD. Therefore, the luminance of the organic light-emitting display panel 10 may not be uniform. For example, the luminance of the organic light-emitting display panel 10 may be gradually reduced in a direction from the $n^{th}$ scan line adjacent to the side of the organic light-emitting display panel 10, from which the first power supply voltage ELVDD is applied, to the $zero^{th}$ scan line. The organic light-emitting display device 1 may control the data driver 40 to generate the first through $m^{th}$ data signals D1 through Dm, which can compensate for a drop in the first power supply voltage ELVDD, by varying a gamma voltage GV which will be described below. The first through $m^{th}$ data signals D1 through Dm may make the luminance of the organic light-emitting display panel 10 uniform, thereby improving display quality.

The data driver 40 may generate the first through $m^{th}$ data signals D1 through Dm. The first through $m^{th}$ data signals D1 through Dm may correspond to an image which is to be displayed on the organic light-emitting display panel 10. More specifically, the first through $m^{th}$ data signals D1 through Dm may correspond to luminance levels of the pixels PX. The data driver 40 may generate the first through $m^{th}$ data signals D1 through Dm corresponding to a data driver control signal DCS and the gamma voltage GV. The data driver control signal DCS may include information about gray levels of an image to be displayed on the organic light-emitting display panel 10. The gamma voltage GV may include a plurality of voltages corresponding to the gray levels of the image. For example, the gamma voltage GV may include a plurality of voltages respectively corresponding to 0 to 255 gray levels. The data driver 40 may generate voltage values, which correspond to gray levels of an image from among the voltages included in the gamma voltage GV, as the first through $m^{th}$ data signals D1 through Dm.

The gamma voltage generator 70 generates the gamma voltage GV. The gamma voltage GV is provided to the data driver 40. The gamma voltage GV varies in the same period as each of a plurality of frames of an image displayed on the organic light-emitting display panel 10. Specifically, the gamma voltage generator 70 may generate the gamma voltage GV which varies in the same period as each of a plurality of frames of an image so that the data driver 40 can generate the first through $m^{th}$ data signals D1 through Dm which can compensate for a drop in the first power supply voltage ELVDD. The gamma voltage generator 70 may receive a gamma control signal GCS and generate the gamma voltage GV corresponding to the gamma control signal GCS. The gamma control signal GCS may include a primitive gamma reference voltage PGRV. The primitive gamma reference voltage PGRV will be described in detail below with reference to FIG. 5.

The organic light-emitting display device 1 may further include a timing controller 20, a scan driver 30, a power supply 60, and an emission driver 50.

The timing controller 20 may receive image data R,G,B and generate a scan driver control signal SCS, the data driver control signal DCS, an emission driver control signal ECS, a power supply control signal VCS and the gamma control signal GCS corresponding to the image data R,G,B.

The scan driver 30 may receive the scan driver control signal SCS and generate the $zero^{th}$ through $n^{th}$ scan signals S0 through Sn corresponding to the scan driver control signal SCS. Each of the $zero^{th}$ through $n^{th}$ scan signals S0 through Sn generated by the scan driver 30 may have an electric potential of a scan-on voltage or a scan-off voltage. The $zero^{th}$ through $n^{th}$ scan signals S0 through Sn may sequentially have the electric potential of the scan-on voltage. A period during which the $zero^{th}$ through $n^{th}$ scan signals S0 through Sn sequentially have the electric potential of the scan-on voltage may be the same as a period of each frame of an image displayed on the organic light-emitting display panel 10. That is, the $zero^{th}$ through $n^{th}$ scan signals S0 through Sn may sequentially have the scan-on voltage once each during one frame. For example, the $zero^{th}$ through $n^{th}$ scan signals S0 through Sn may sequentially have the electric potential of the scan-on voltage in order of the $zero^{th}$ scan signal S0 to the $n^{th}$ scan signal Sn. According to some embodiments, the $zero^{th}$ through $n^{th}$ scan signals S0 through Sn may have the electric potential of the scan-on voltage in order of the $n^{th}$ scan signal Sn to the $zero^{th}$ scan signal S0. When the first through $n^{th}$ scan signals S1 through Sn have the electric potential of the scan-on voltage, the first through $m^{th}$ data signals D1 through Dm may be transmitted to the pixels PX.

The scan driver control signal SCS may include a vertical synchronization signal Vsync. The scan driver 30 may generate the $zero^{th}$ through $n^{th}$ scan signals S0 through Sn in synchronization with the vertical synchronization signal Vsync. For example, the vertical synchronization signal Vsync may provide a starting point from which the electric potential of the scan-on voltage can be applied sequentially to the $zero^{th}$ through $n^{th}$ scan signals S0 through Sn within one frame of an image displayed on the organic light-emitting display panel 10.

The emission driver 50 may receive the emission driver control signal ECS and generate the first through $n^{th}$ emission control signals EM1 through EMn corresponding to the emission driver control signal ECS. Each of the first through $n^{th}$ emission control signals EM1 through EMn may have an electric potential of an emission-on voltage or an emission-off voltage. Organic light-emitting diodes included in pixels PX which receive the first through $n^{th}$ emission control signals EM1 through EMn having the electric potential of the emission-on voltage may emit light. After an electric potential of an $i^{th}$ scan signal Si changes from the scan-on voltage to the scan-off voltage, an electric potential of an $i^{th}$ emission control signal EMi may change from the emission-off voltage to the emission-on voltage, where i is a natural number from 1 to n.

The power supply 60 may provide the initialization voltage VINT, the first power supply voltage ELVDD and the second power supply voltage ELVSS to the organic light-emitting display panel 10. The first power supply voltage ELVDD may have a higher value than the second power supply voltage ELVSS. The first power supply voltage ELVDD may be provided to a side of the organic light-emitting display panel 10. The first power supply voltage ELVDD provided to the side of the organic light-emitting display panel 10 may have a lower value in a region adjacent to the other side of the organic light-emitting display panel 10 than at the above side due to the internal resistance of the wiring in the organic light-emitting display panel 10.

Figure 2:
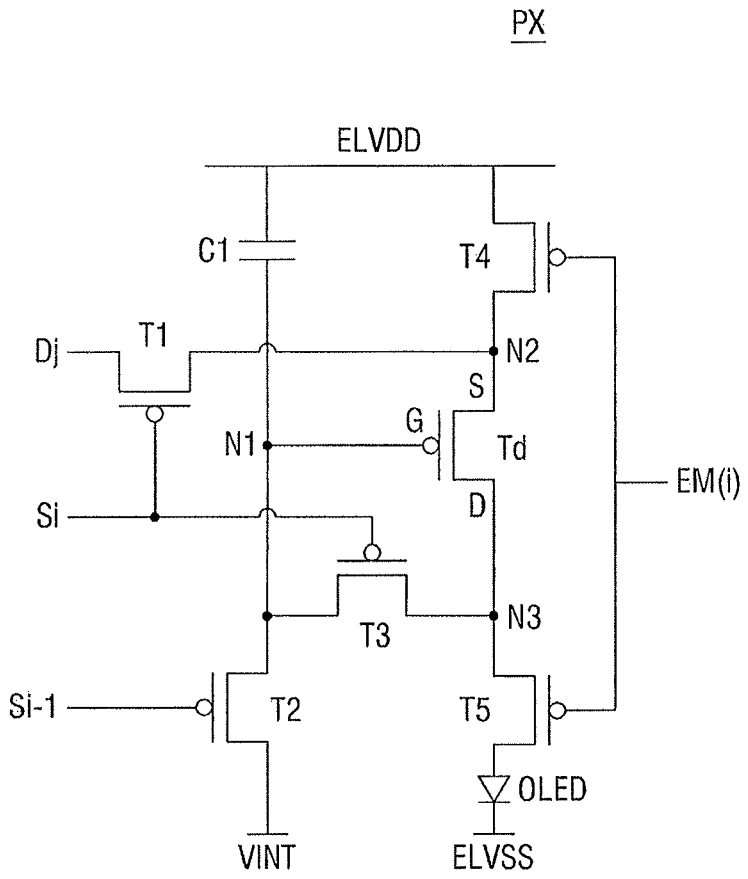
FIG. 2 is a circuit diagram of a pixel according to an embodiment.

A pixel PX will now be described with reference to FIG. 2. FIG. 2 is a circuit diagram of a pixel PX according to an embodiment.

Referring to FIG. 2, the pixel PX may include a data control transistor T1, a driving transistor Td, an organic light-emitting diode OLED, and a capacitor C1.

The organic light-emitting diode OLED may emit light at a luminance level corresponding to the magnitude of an electric current which flows in a direction from an anode of the organic light-emitting diode OLED to a cathode. The second power supply voltage ELVSS may be applied to the cathode of the organic light-emitting diode OLED. The anode of the organic light-emitting diode OLED may be connected to a third node N3, and a second emission control transistor T5 may control connection of the anode of the organic light-emitting diode OLED to the third node N3.

The driving transistor Td may include a source S connected to a second node N2 to which the first power supply voltage ELVDD is applied, a drain D connected to the third node N3, and a gate G connected to a first node N1. The driving transistor Td may receive a $j^{th}$ data signal Dj through the data control transistor T1 connected to the second node N2, where j is a natural number from 1 to m. The driving transistor Td may control an electric current flowing through the organic light-emitting diode OLED. The magnitude of the electric current flowing through the organic light-emitting diode OLED may correspond to a potential difference between the source S and the gate G of the driving transistor Td.

The data control transistor T1 may include a source provided with the jth data signal Dj, a drain connected to the second node N2, and a gate provided with the ith scan signal Si. When the ith scan signal Si has the electric potential of the scan-on voltage, the data control transistor T1 may be turned on to provide the jth data signal Dj to the second node N2.

A first terminal of the capacitor C1 may be connected to the first node N1 which is connected to the gate G of the driving transistor Td, and the first power supply voltage ELVDD may be applied to a second terminal of the capacitor C1. Therefore, the capacitor C1 may store a voltage of the gate G of the driving transistor Td.

The pixel PX may further include a threshold voltage compensation transistor T3. The $i^{th}$ scan signal Si may be transmitted to a gate of the threshold voltage compensation transistor T3. When the $i^{th}$ scan signal Si has the electric potential of the scan-on voltage, the threshold voltage compensation transistor T3 is turned on. The threshold voltage compensation transistor T3 may connect the gate G and the drain D of the driving transistor Td, thereby diode-connecting the driving transistor Td. When the driving transistor Td is diode-connected, a voltage, which dropped from a voltage of the $j^{th}$ data signal Dj transmitted to the source S of the driving transistor Td by a threshold voltage of the driving transistor Td, is applied to the gate G of the driving transistor Td. The gate G of the driving transistor Td is connected to the first terminal of the capacitor C1. Accordingly, the voltage applied to the gate G of the driving transistor Td may be maintained. The voltage which reflects the threshold voltage of the driving transistor Td is applied to the gate G and maintained accordingly. Thus, an electric current flowing between the source S and the drain D of the driving transistor Td may not be affected by the threshold voltage of the driving transistor Td.

The pixel PX may further include an initialization transistor T2. An $(i-1)^{th}$ scan signal Si−1 may be transmitted to a gate of the initialization transistor T2. When the $(i-1)^{th}$ scan signal Si−1 has the electric potential of the scan-on voltage, the initialization transistor T2 is turned on to provide the initialization voltage VINT to the gate G of the driving transistor Td. As a result, an electric potential of the gate G of the driving transistor Td may be initialized.

The pixel PX may further include a first emission control transistor T4, in addition to the second emission control transistor T5. The $i^{th}$ emission control signal EMi may be transmitted to a gate electrode of the first emission control transistor T4. When the $i^{th}$ emission control signal EMi has the electric potential of the emission-on voltage, the first emission control transistor T4 may be turned on to provide the first power supply voltage ELVDD to the second node N2. The $i^{th}$ emission control signal EMi may also be transmitted to a gate electrode of the second emission control transistor T5. When the $i^{th}$ emission control signal EMi has the electric potential of the emission-on voltage, the second emission control transistor T5 may be turned on to connect the third node N3 and the anode of the organic light-emitting diode OLED. When the $i^{th}$ emission control signal EMi has the electric potential of the emission-on voltage, if the first emission control transistor T4 and the second emission control transistor T5 are turned on, an electric current corresponding to the voltage of the $j^{th}$ data signal Dj stored in the capacitor C1 is generated between the source S and the drain D of the driving transistor Td for a period of time during which the $i^{th}$ scan signal Si has the electric potential of the scan-on voltage. The electric current may flow to the organic light-emitting diode OLED, thus causing the organic light-emitting diode OLED to emit light.

Figure 3:
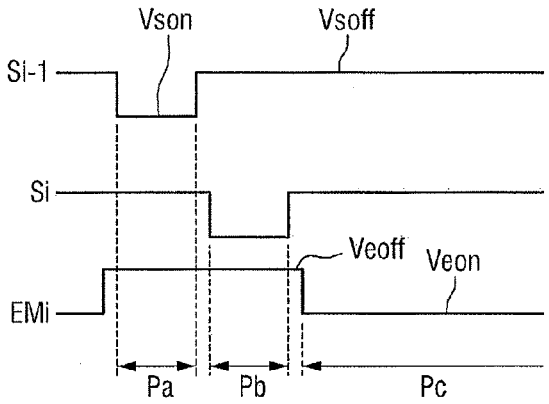
FIG. 3 is a waveform diagram of $i^{th}$ and $(i-1)^{th}$ scan signals and an $i^{th}$ emission control signal according to an embodiment.

The operation of the pixel PX will now be described in more detail with reference to FIG. 3. FIG. 3 is a waveform diagram of the $i^{th}$ and $(i-1)^{th}$ scan signals Si and Si−1 and the $i^{th}$ emission control signal EMi according to an embodiment.

Referring to FIG. 3, the $(i-1)^{th}$ scan signal Si−1 may have the electric potential of the scan-on voltage Vson during an $a^{th}$ period Pa. The initialization transistor T2 provided with the $(i-1)^{th}$ scan signal Si−1 may be turned on during the $a^{th}$ period Pa to initialize the electric potential of the gate G of the driving transistor Td to the initialization voltage VINT.

In a $b^{th}$ period Pb following the $a^{th}$ period Pa, the $i^{th}$ scan signal Si may have the electric potential of the scan-on voltage Vson, and the $(i-1)^{th}$ scan signal Si−1 may have the electric potential of the scan-off voltage Vsoff. In the $b^{th}$ period Pb, the initialization transistor T2 may be turned off. Thus, the second node N2 may be floating. Also, the data control transistor T1 and the threshold voltage compensation transistor T3 which receive the $i^{th}$ scan signal Si may be turned on in the $b^{th}$ period Pb. Then, in the $b^{th}$ period Pb, a data voltage corresponding to the $j^{th}$ data signal Dj may be transmitted to the source S of the driving transistor Td through the data control transistor T1, and the driving transistor Td may be diode-connected by the threshold voltage compensation transistor T3. Therefore, a voltage maintained at the first node N1, which is connected to the first terminal of the capacitor C1, during the $b^{th}$ period Pb may correspond to the potential difference between the gate G and the source S of the driving transistor Td. The voltage may be a voltage that has dropped from the voltage corresponding to the $j^{th}$ data signal Dj by the threshold voltage of the driving transistor Td.

In a $c^{th}$ period Pc following the $b^{th}$ period Pb, the $i^{th}$ emission control signal Emi, which had the electric potential of the emission-off voltage Veoff in the $a^{th}$ period Pa and the $b^{th}$ period Pb, may have the electric potential of the emission-on voltage Veon. In the $c^{th}$ period Pc, the $i^{th}$ scan signal Si and the $(i-1)^{th}$ scan signal Si−1 may have the electric potential of the emission-off voltage Vsoff. In the $c^{th}$ period Pc, the first and second emission control transistors T4 and T5 to which the $i^{th}$ emission control signal EMi is transmitted are turned on to provide an electric current corresponding to a voltage stored in the capacitor C1 to the organic light-emitting diode OLED. Accordingly, the organic light-emitting diode OLED may emit light.

Figure 4:
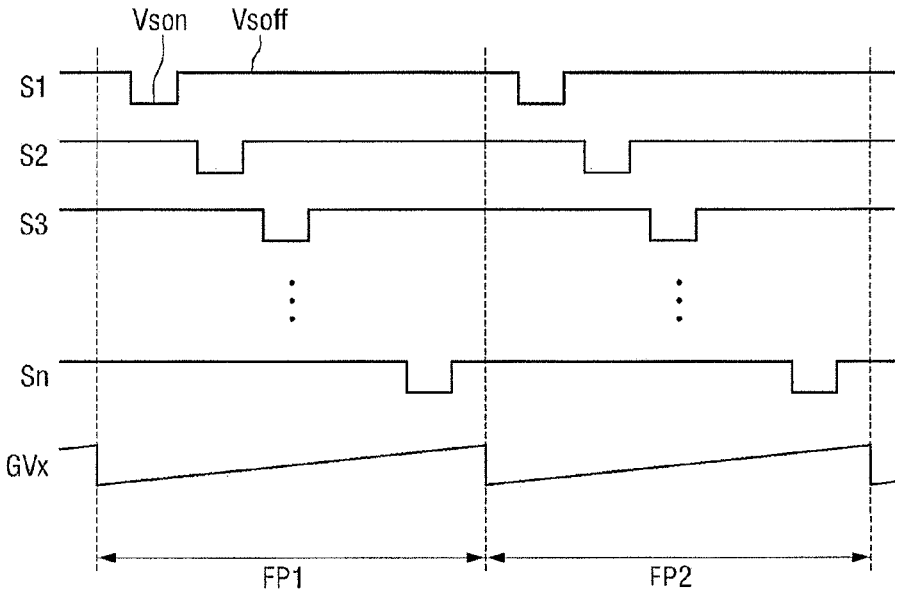
FIG. 4 is a waveform diagram of first through $n^{th}$ scan signals and an $x^{th}$ gamma voltage according to an embodiment.

The variation in the gamma voltage GV will now be described in more detail with reference to FIG. 4. FIG. 4 is a waveform diagram of the first through $n^{th}$ scan signals S1 through Sn and an $x^{th}$ gamma voltage GVx according to an embodiment.

Referring to FIG. 4, each of the first through $n^{th}$ scan signals S1 through Sn may have a scan-on section and a scan-off section. In the scan-on section, each of the first through $n^{th}$ scan signals S1 through Sn may have the electric potential of the scan-on voltage Vson. In the scan-off section, each of the first through $n^{th}$ scan signals S1 through Sn may have the electric potential of the scan-off voltage Vsoff. In one frame of an image displayed on the organic light-emitting display panel 10, the first through $n^{th}$ scan signals S1 through Sn may sequentially have the electric potential of the scan-on voltage Vson. For example, the first through $n^{th}$ scan signals S1 through Sn may sequentially have the electric potential of the scan-on voltage Vson in a first frame period FP1. The same applies in a second frame period FP2 following the first frame period FP1. Although not shown in the drawing, in the first frame period FP1, the $zero^{th}$ scan signal S0 may have the electric potential of the scan-on voltage Vson before the first scan signal S1 has the electric potential of the scan-on voltage Vson. That is, if the first power supply voltage ELVDD is applied to a side of the organic light-emitting display panel 10 which is adjacent to a scan line to which the nth scan signal Sn is transmitted, the scan-on voltage Vson may be applied to the first through $n^{th}$ scan lines S1 through Sn sequentially in order of a scan line located farthest from the side of the organic light-emitting display panel 10 to which the first power supply voltage ELVDD is applied to a scan line located closest to the side of the organic light-emitting display panel 10 to which the first power supply voltage ELVDD is applied.

The gamma voltage GV may include first through $o^{th}$ gamma voltages GV1 through GVo. Each of the first through $o^{th}$ gamma voltages GV1 through GVo may correspond to certain gray data. The $x^{th}$ gamma voltage GVx may vary in the same period as each frame of an image displayed on the organic light-emitting display panel 10, where x is a natural number from 1 to o. The first through $o^{th}$ gamma voltages GV1 through GVo may vary in substantially the same way as the $x^{th}$ gamma voltage GVx. In the first frame period FP1, the $x^{th}$ gamma voltage GVx may increase continuously. The $x^{th}$ gamma voltage GVx may also increase continuously in the second frame period FP2.

If the first power supply voltage ELVDD is applied to a side of the organic light-emitting display panel 10 which is adjacent to a scan line to which the $n^{th}$ scan signal Sn is transmitted, the gamma voltage GV has a higher electric potential when the scan-on voltage Vson is applied to a scan line closer to the side. Therefore, for the same gray data, a relatively higher data voltage is applied to a pixel PX close to the side of the organic light-emitting display panel 10 to which the first power supply voltage ELVDD is applied than to a pixel PX far away from the side. Each of the pixels PX emits light at a brightness level corresponding to a potential difference between the first power supply voltage ELVDD and a data voltage, and a value of the first power supply voltage ELVDD is reduced as the distance from the side of the organic light-emitting display panel 10 which is adjacent to the scan line to which the $n^{th}$ scan signal Sn is transmitted increases.

Therefore, the organic light-emitting display device 1 controls the gamma voltage GV to increase in the same period as each frame of an image, so that a relatively low data voltage is applied to a pixel PX to which a relatively low first power supply voltage ELVDD is applied and that a relatively high data voltage is applied to a pixel PX to which a relatively high first power supply voltage ELVDD is applied. Accordingly, the potential difference between the first power supply voltage ELVDD and the data voltage can be maintained constant for the same gray data. This can compensate for a voltage drop due to the resistance of the first power supply voltage ELVDD, thereby improving display quality. In FIG. 4, the $x^{th}$ gamma voltage GVx increases linearly within one frame. However, this is merely an example, and the $x^{th}$ gamma voltage GVx may vary according to a drop in the first power supply voltage ELVDD. For example, the $x^{th}$ gamma voltage GVx may increase nonlinearly.

Figure 5:
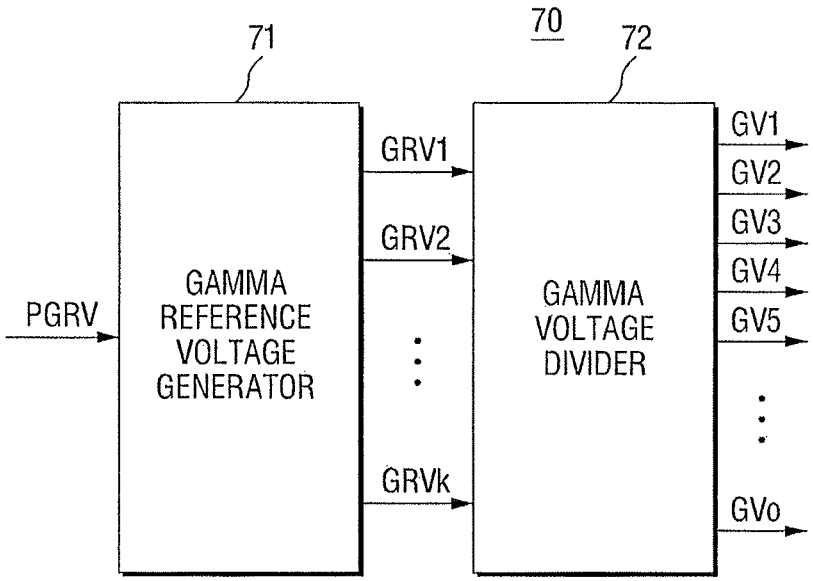
FIG. 5 is a block diagram of a gamma voltage generator according to an embodiment.

The gamma voltage generator 70 will now be described with reference to FIG. 5. FIG. 5 is a block diagram of the gamma voltage generator 70 according to an embodiment.

Referring to FIG. 5, the gamma voltage generator 70 may include a gamma reference voltage generator 71 and a gamma voltage divider 72. The gamma reference voltage generator 71 may generate, from the primitive gamma reference voltage PGRV, first through $k^{th}$ gamma reference voltages GRV1 through GRVk arranged in order of highest to lowest electric potential. That is, of the first through $k^{th}$ gamma reference voltages GRV1 through GRVk, the first gamma reference voltage GRV1 may have the highest electric potential, and the $k^{th}$ gamma reference voltage GRVk may have the lowest electric potential. The gamma reference voltage generator 71 may output the primitive gamma reference voltage PGRV as the first gamma reference voltage GRV1. The gamma reference voltage generator 71 may divide the primitive gamma reference voltage PGRV into the second through $k^{th}$ gamma reference voltages GRV2 through GRVk. Therefore, when the primitive gamma reference voltage PGRV varies, the first through $k^{th}$ gamma reference voltages GRV1 through GRVk may vary accordingly.

The gamma voltage divider 72 may receive the first through $k^{th}$ gamma reference voltages GRV1 through GRVk and generate the first through $o^{th}$ gamma voltages GV1 through GVo respectively corresponding to the first through $k^{th}$ gamma reference voltages GRV1 through GRVk. The gamma voltage GV shown in FIG. 1 may include the first through $o^{th}$ gamma voltages GV1 through GVo. The first through $o^{th}$ gamma voltages GV1 through GVo may be arranged in order of highest to lowest electric potential. That is, of the first through $o^{th}$ gamma voltages GV1 through GVo, the first gamma voltage GV1 may have the highest electric potential, and the $o^{th}$ gamma voltage GVo may have the lowest electric potential.

The first through $k^{th}$ gamma reference voltages GRV1 through GRVk may provide a basis from which the gamma voltage divider 72 generates the first through $o^{th}$ gamma voltages GRV1 through GRVk. For example, the gamma voltage divider 72 may generate the first gamma voltage GV1 identical to the first gamma reference voltage GRV1 and generate an $a^{th}$ gamma voltage GVa identical to the second gamma reference voltage GRV2, where a is a natural number between 1 and o. The gamma voltage divider 72 may divide a voltage between the first gamma reference voltage GRV1 and the second gamma reference voltage GRV2 into second through $(a-1)^{th}$ gamma voltages GV2 through GVa−1. In this way, the gamma voltage divider 72 may generate the first through $o^{th}$ gamma voltages GV1 through GVo from the first through $k^{th}$ gamma reference voltages GRV1 through GRVk and a voltage between every two of the first through $k^{th}$ gamma reference voltages GRV1 through GRVk. Therefore, when the first through $k^{th}$ gamma reference voltages GRV1 through GRVk vary, the first through $o^{th}$ gamma voltages GV1 through GVo may vary accordingly. In addition, when the primitive gamma reference voltage PGRV varies, the first through $k^{th}$ gamma reference voltages GRV1 through GRVk may vary accordingly. Consequently, the first through $o^{th}$ gamma voltages GV1 through GVo may vary according to the primitive gamma reference voltage PGRV.

Figure 6:
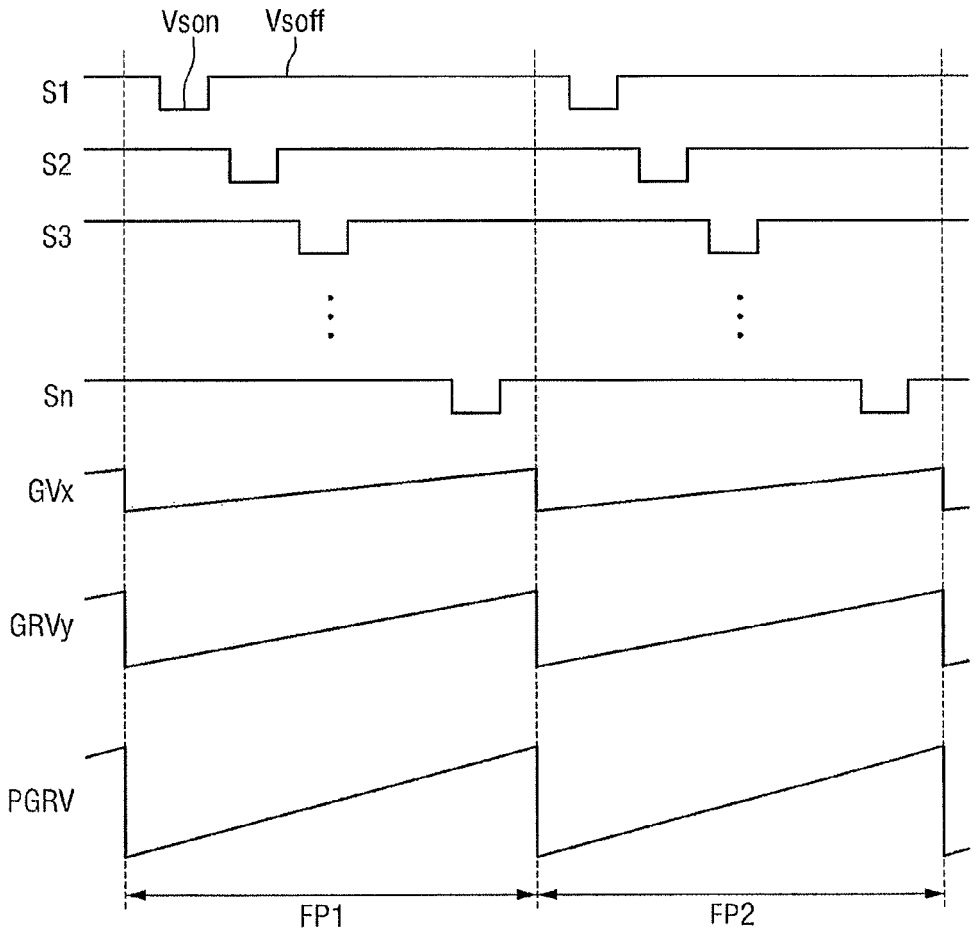
FIG. 6 is a waveform diagram of the first through $n^{th}$ scan signals, the $x^{th}$ gamma voltage, an $y^{th}$ gamma reference voltage, and a primitive gamma reference voltage according to an embodiment.

The primitive gamma reference voltage PGRV and the first through $k^{th}$ gamma reference voltages GRV1 through GRVk will now be described in more detail with reference to FIG. 6. FIG. 6 is a waveform diagram of the first through $n^{th}$ scan signals S1 through Sn, the $x^{th}$ gamma voltage GVx, an $y^{th}$ gamma reference voltage GRVy, and the primitive gamma reference voltage PGRV according to an embodiment. Here, y is a natural number from 1 to k.

Referring to FIG. 6, the first through $n^{th}$ scan signals S1 through Sn and the $x^{th}$ gamma voltage GVx vary in substantially the same way as the way described above with reference to FIG. 4. To change the $x^{th}$ gamma voltage GVx as shown in FIG. 6, the $y^{th}$ gamma reference voltage GRVy may vary in the same period as each frame of an image displayed on the organic light-emitting display panel 10. The first through $k^{th}$ gamma reference voltages GRV1 through GRVk may vary in substantially the same way as the $y^{th}$ gamma reference voltage GRVy. In the first frame period FP1, the $y^{th}$ gamma reference voltage GRVy may increase continuously. The $y^{th}$ gamma reference voltage GRVy may also increase continuously in the second frame period FP2. As described above, the first through $o^{th}$ gamma voltages GV1 through GVo vary according to the first through $k^{th}$ gamma reference voltages GRV1 through GRVk. Therefore, if the $y^{th}$ gamma reference voltage GRVy varies as shown in FIG. 6, the first through $o^{th}$ gamma voltages GV1 through GV0 may vary accordingly to compensate for a voltage drop due to the resistance of the first power supply voltage ELVDD. As a result, display quality can be improved. In FIG. 6, the $y^{th}$ gamma reference voltage GRVy increases linearly. However, this is merely an example, and the $y^{th}$ gamma reference voltage GRVy may vary according to a drop in the first power supply voltage ELVDD. For example, the $y^{th}$ gamma reference voltage GRVy may increase non-linearly.

To change the $y^{th}$ gamma reference voltage GRVy as shown in FIG. 6, the primitive gamma reference voltage PGRV may vary in the same period as each frame of an image displayed on the organic light-emitting display panel 10. In the first frame period FP1, the primitive gamma reference voltage PGRV may increase continuously. The primitive gamma reference voltage PGRV may also increase continuously in the second frame period FP2. In FIG. 6, the primitive gamma reference voltage PGRV increases linearly. However, this is merely an example, and the primitive gamma reference voltage PGRV may vary according to a drop in the first power supply voltage ELVDD. For example, the primitive gamma reference voltage PGRV may increase non-linearly.

Figure 7:
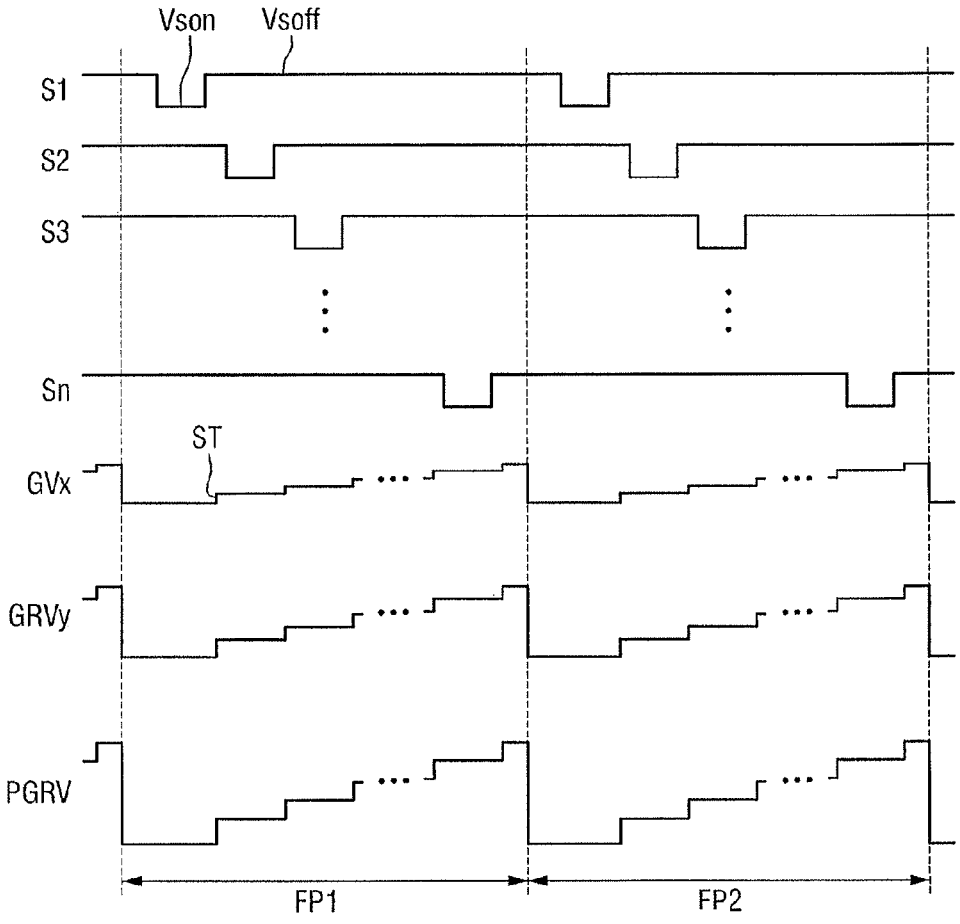
FIG. 7 is a waveform diagram of first through $n^{th}$ scan signals, an $x^{th}$ gamma voltage, an $y^{th}$ gamma reference voltage, and a primitive gamma reference voltage according to another embodiment.

Another embodiment will now be described with reference to FIG. 7. FIG. 7 is a waveform diagram of first through $n^{th}$ scan signals S1 through Sn, an $x^{th}$ gamma voltage GVx, an $y^{th}$ gamma reference voltage GRVy, and a primitive gamma reference voltage PGRV according to another embodiment.

Referring to FIG. 7, a description of the first through $n^{th}$ scan signals S1 through Sn is substantially identical to the description of the first through $n^{th}$ scan signals S1 through Sn in FIG. 4. The first through $n^{th}$ scan signals S1 through Sn may vary in the same period as each frame of an image displayed on the organic light-emitting display panel 10.

The $x^{th}$ gamma voltage GVx may increase in a stepped manner within one frame. It may be easier to make the $x^{th}$ gamma voltage GVx vary in a stepped manner than to make the $x^{th}$ gamma voltage GVx vary continuously. Even if the $x^{th}$ gamma voltage GVx varies in a stepped manner, it can still compensate for a voltage drop due to the resistance of the first power supply voltage ELVDD. Therefore, the display quality of the organic light-emitting display device 1 can be improved. In FIG. 7, when the $x^{th}$ gamma voltage GVx varies in a stepped manner, the number of values that the $x^{th}$ gamma voltage GVx can have is n. However, in other implementations, the number of values that the $x^{th}$ gamma voltage GVx can have may be n/2, n/3, or any other value.

The value of the $x^{th}$ gamma voltage GVx may change at a shift time ST. The shift time ST may not overlap a section (i.e., the scan-on section) in which each of the first through $n^{th}$ scan signals S1 through Sn has the scan-on voltage Vson. If the shift time ST does not overlap the scan-on section, noise generated when voltage levels of the first through $m^{th}$ data signals D1 through Dm transmitted to the pixels PX change instantaneously can be prevented or hindered from being delivered to the pixels PX. Consequently, a reduction in the display quality of the organic light-emitting display device 1 may be prevented or reduced.

The $y^{th}$ gamma reference voltage GRVy and the primitive gamma reference voltage PGRV may vary in substantially the same way as the $x^{th}$ gamma voltage GVx.

Figure 8:
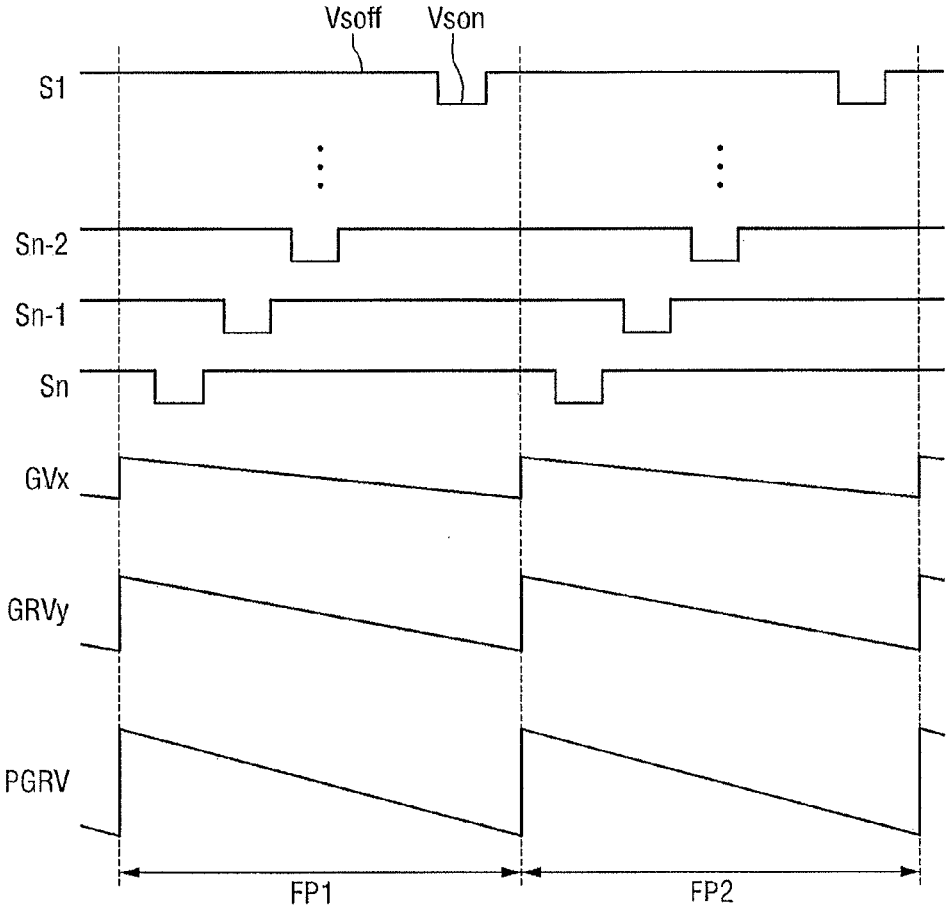
FIG. 8 is a waveform diagram of first through $n^{th}$ scan signals, an $x^{th}$ gamma voltage, an $y^{th}$ gamma reference voltage, and a primitive gamma reference voltage according to another embodiment.

Another embodiment will now be described with reference to FIG. 8. FIG. 8 is a waveform diagram of first through $n^{th}$ scan signals S1 through Sn, an $x^{th}$ gamma voltage GVx, an $y^{th}$ gamma reference voltage GRVy, and a primitive gamma reference voltage PGRV according to another embodiment.

Referring to FIG. 8, the first through $n^{th}$ scan signals S1 through Sn may sequentially have the electric potential of the scan-on voltage Vson within one frame in order of the $n^{th}$ scan signal Sn to the first scan signal S1. In this case, since the first power supply voltage ELVDD is applied to a side of the organic light-emitting display panel 10 which is adjacent to the $n^{th}$ scan line Sn, the scan-on voltage Vson may be applied to the first through $n^{th}$ scan signals S1 through Sn sequentially in order of a scan line closest to the side of the organic light-emitting display panel 10 to which the first power supply voltage ELVDD is applied to a scan line farthest from the side.

The $x^{th}$ gamma voltage GVx may vary in the same period as each frame of an image displayed on the organic light-emitting display panel 10. In a first frame period FP1, the $x^{th}$ gamma voltage GVx may decrease continuously. The $x^{th}$ gamma voltage GVx may also decrease continuously in a second frame period FP2. If the first power supply voltage ELVDD is applied to a side of the organic light-emitting display panel 10 which is adjacent to a scan line to which the $n^{th}$ scan signal Sn is transmitted, the $x^{th}$ gamma voltage GVx has a higher electric potential when the scan-on voltage Vson is applied to a scan line closer to the side. Therefore, for the same gray data, a relatively higher data voltage is applied to a pixel PX close to the side of the organic light-emitting display panel 10 to which the first power supply voltage ELVDD is applied than to a pixel PX far away from the side. Each of the pixels PX emits light at a brightness level corresponding to a potential difference between the first power supply voltage ELVDD and a data voltage, and the value of the first power supply voltage ELVDD is reduced as the distance from the side of the organic light-emitting display panel 10 which is adjacent to the scan line to which the $n^{th}$ scan signal Sn is transmitted increases.

Therefore, the organic light-emitting display device 1 controls the $x^{th}$ gamma voltage GVx to decrease in the same period as each frame of an image, so that a relatively low data voltage is applied to a pixel PX to which a relatively low first power supply voltage ELVDD is applied and that a relatively high data voltage is applied to a pixel PX to which a relatively high first power supply voltage ELVDD is applied. Accordingly, the potential difference between the first power supply voltage ELVDD and the data voltage can be maintained constant for the same gray data. Accordingly, a voltage drop due to the resistance of the first power supply voltage ELVDD may be compensated for, thereby improving display quality. In FIG. 8, the $x^{th}$ gamma voltage GVx decreases linearly within one frame. However, this is merely an example, and the $x^{th}$ gamma voltage GVx may vary according to a drop in the first power supply voltage ELVDD. For example, the $x^{th}$ gamma voltage GVx may decrease non-linearly.

The $y^{th}$ gamma reference voltage GRVy and the primitive gamma reference voltage PGRV may vary in substantially the same way as the $x^{th}$ gamma voltage GVx.

Figure 9:
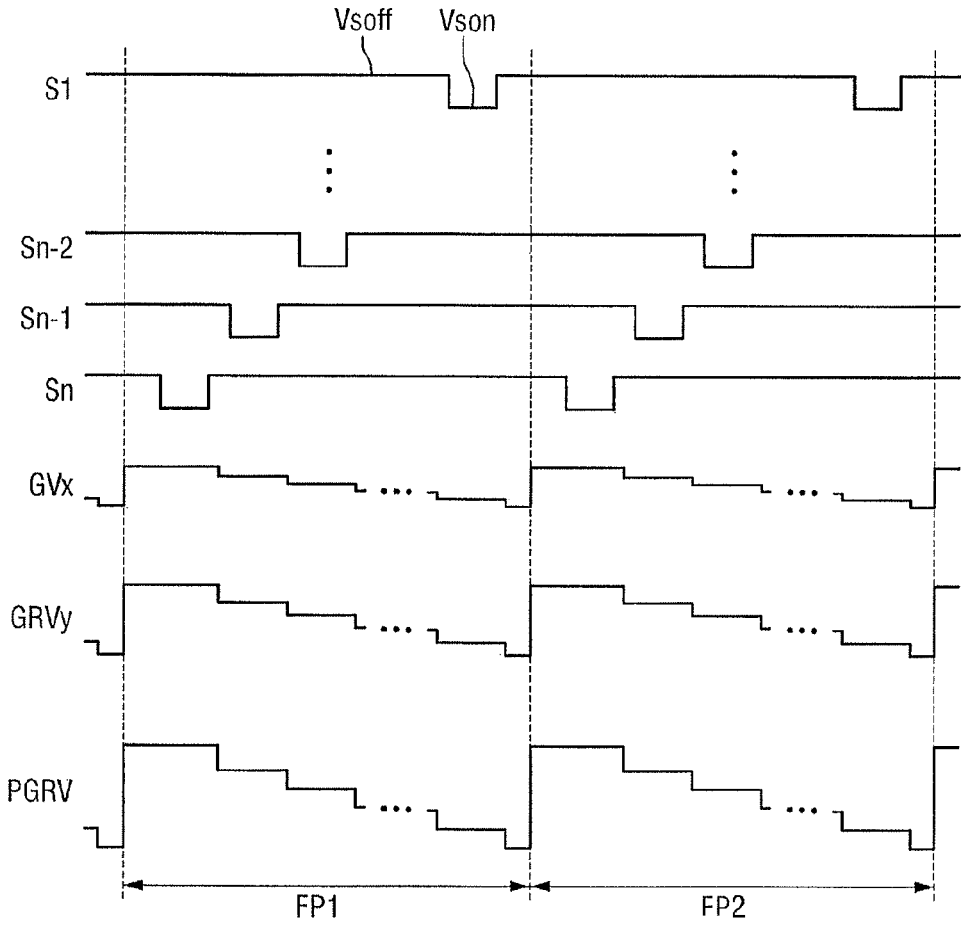
FIG. 9 is a waveform diagram of first through $n^{th}$ scan signals, an $x^{th}$ gamma voltage, an $y^{th}$ gamma reference voltage, and a primitive gamma reference voltage according to another embodiment.

Another embodiment will now be described with reference to FIG. 9. FIG. 9 is a waveform diagram of first through $n^{th}$ scan signals S1 through Sn, an $x^{th}$ gamma voltage GVx, an $y^{th}$ gamma reference voltage GRVy, and a primitive gamma reference voltage PGRV according to another embodiment.

Referring to FIG. 9, a description of the first through $n^{th}$ scan signals S1 through Sn is substantially identical to the description of the first through $n^{th}$ scan signals S1 through Sn in FIG. 8. The $x^{th}$ gamma voltage GVx may vary in the same period as each frame of an image displayed on the organic light-emitting display panel 10. The $x^{th}$ gamma voltage GVx may decrease in a stepped manner within one frame. It may be easier to make the $x^{th}$ gamma voltage GVx vary in a stepped manner than to make the $x^{th}$ gamma voltage GVx vary continuously. Even if the $x^{th}$ gamma voltage GVx varies in a stepped manner, it can still compensate for a voltage drop due to the resistance of the first power supply voltage ELVDD. Therefore, the display quality of the organic light-emitting display device 1 can be improved. In FIG. 9, when the $x^{th}$ gamma voltage GVx varies in a stepped manner, the number of values that the $x^{th}$ gamma voltage GVx can have is n. However, in other implementations, the number of values that the $x^{th}$ gamma voltage GVx can have may be n/2, n/3, or any other value.

The value of the $x^{th}$ gamma voltage GVx may change at a shift time ST. The shift time ST may not overlap a section (i.e., the scan-on section) in which each of the first through $n^{th}$ scan signals S1 through Sn has the scan-on voltage Vson. If the shift time ST does not overlap the scan-on section, noise generated when the voltage levels of the first through $m^{th}$ data signals D1 through Dm transmitted to the pixels PX change instantaneously can be prevented or hindered from being delivered to the pixels PX. Consequently, this can prevent or reduce a reduction in the display quality of the organic light-emitting display device 1.

The $y^{th}$ gamma reference voltage GRVy and the primitive gamma reference voltage PGRV may vary in substantially the same way as the $x^{th}$ gamma voltage GVx.

Figure 10:
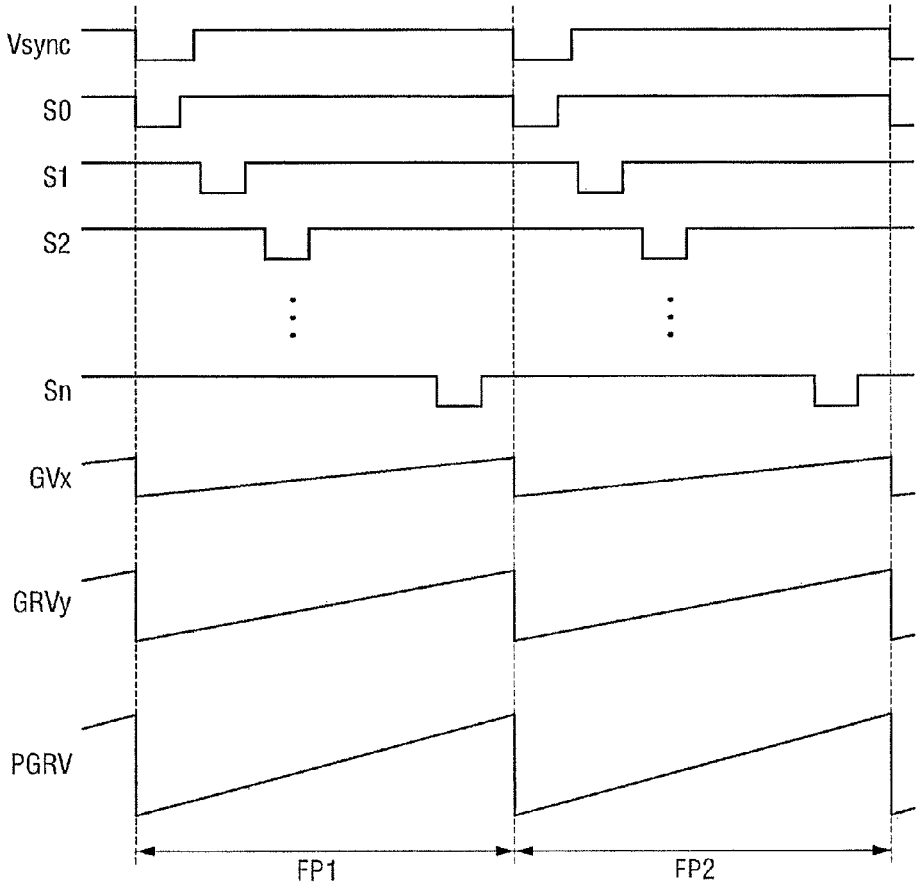
FIG. 10 is a waveform diagram of a vertical synchronization signal, first through $n^{th}$ scan signals, an $x^{th}$ gamma voltage, an $y^{th}$ gamma reference voltage, and a primitive gamma reference voltage according to another embodiment.

Another embodiment will now be described with reference to FIG. 10. FIG. 10 is a waveform diagram of a vertical synchronization signal Vsync, first through $n^{th}$ scan signals S1 through Sn, an $x^{th}$ gamma voltage GVx, an $y^{th}$ gamma reference voltage GRVy, and a primitive gamma reference voltage PGRV according to another embodiment.

Referring to FIG. 10, the vertical synchronization signal Vsync may provide synchronization for generation of the $zero^{th}$ through $n^{th}$ scan signals S0 through Sn to the scan driver 30. For example, the scan driver 30 may begin to generate the $zero^{th}$ through $n^{th}$ scan signals S0 through Sn in synchronization with a time when the vertical synchronization signal Vsync changes from a high voltage level to a low voltage level. The vertical synchronization signal Vsync may vary in the same period as each frame of an image displayed on the organic light-emitting display panel 10. Each of a first frame period FP1 and a second frame period FP2 may be defined as a period between times at which the vertical synchronization signal Vsync changes from the high voltage level to the low voltage level.

In one frame of an image displayed on the organic light-emitting display panel 10, the $zero^{th}$ through $n^{th}$ scan signals S0 through Sn may sequentially have the electric potential of the scan-on voltage Vson. For example, in the first frame period FP1, the $zero^{th}$ through $n^{th}$ scan signals S0 through Sn may sequentially have the electric potential of the scan-on voltage Vson. The same applies in the second frame period FP2 following the first frame period FP1.

The $x^{th}$ gamma voltage GVx may vary in synchronization with the vertical synchronization signal Vsync and vary in the same period as each frame of an image displayed on the organic light-emitting display panel 10. In the first frame period FP1, the $x^{th}$ gamma voltage GVx may increase continuously. The $x^{th}$ gamma voltage GVx may also increase continuously in the second frame period FP2. The organic light-emitting display device 1 controls the $x^{th}$ gamma voltage GVx to increase in the same period as each frame of an image, so that a relatively low data voltage is applied to a pixel PX to which a relatively low first power supply voltage ELVDD is applied and that a relatively high data voltage is applied to a pixel PX to which a relatively high first power supply voltage ELVDD is applied. Accordingly, a potential difference between the first power supply voltage ELVDD and a data voltage can be maintained constant for the same gray data. This can compensate for a voltage drop due to the resistance of the first power supply voltage ELVDD, thereby improving display quality. In FIG. 10, the $x^{th}$ gamma voltage GVx increases linearly within one frame. However, this is merely an example, and the $x^{th}$ gamma voltage GVx may vary according to a drop in the first power supply voltage ELVDD. For example, the $x^{th}$ gamma voltage GVx may increase non-linearly.

The $y^{th}$ gamma reference voltage GRVy and the primitive gamma reference voltage PGRV may vary in substantially the same way as the $x^{th}$ gamma voltage GVx.

Figure 11:
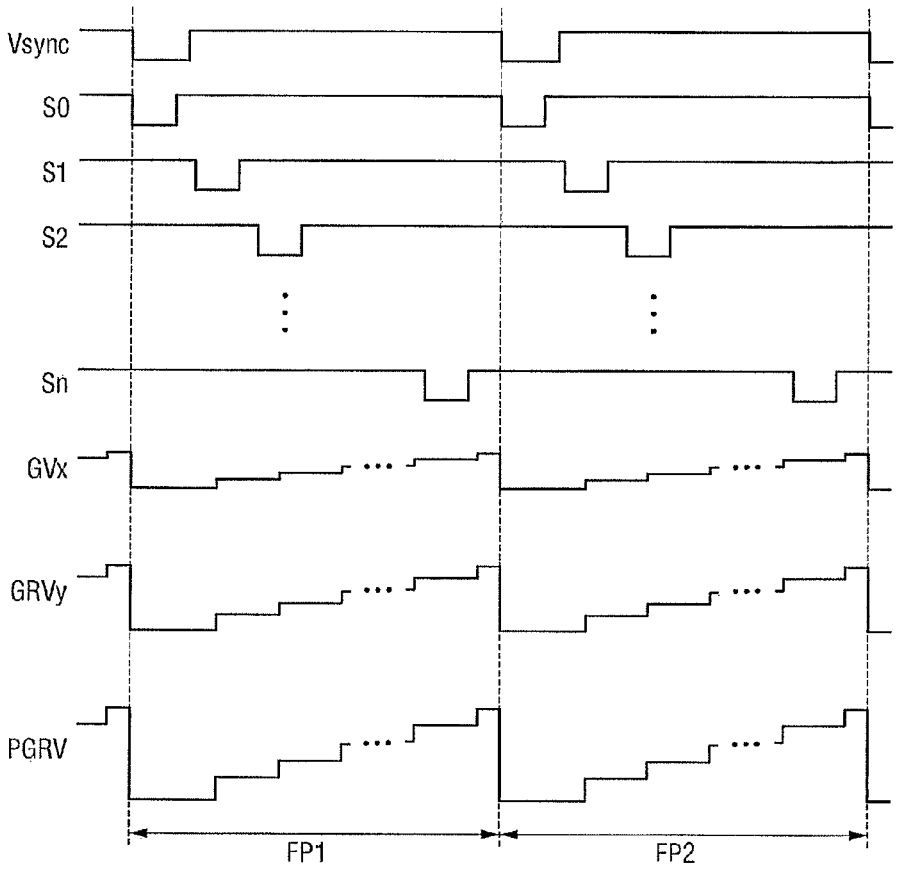
FIG. 11 is a waveform diagram of a vertical synchronization signal, first through $n^{th}$ scan signals, an $x^{th}$ gamma voltage, an $y^{th}$ gamma reference voltage, and a primitive gamma reference voltage according to another embodiment.

Another embodiment will now be described with reference to FIG. 11. FIG. 11 is a waveform diagram of a vertical synchronization signal Vsync, first through $n^{th}$ scan signals S1 through Sn, an $x^{th}$ gamma voltage GVx, an $y^{th}$ gamma reference voltage GRVy, and a primitive gamma reference voltage PGRV according to another embodiment.

Referring to FIG. 11, a description of the vertical synchronization signal Vsync and the $zero^{th}$ through $n^{th}$ scan signals S0 through Sn is substantially identical to the description of the vertical synchronization signal Vsync and the $zero^{th}$ through $n^{th}$ scan signals S0 through Sn in FIG. 10. The $x^{th}$ gamma voltage GVx may vary in synchronization with the vertical synchronization signal Vsync and vary in the same period as each frame of an image displayed on the organic light-emitting display panel 10. The $x^{th}$ gamma voltage GVx may increase in a stepped manner within one frame. Other aspects of the $x^{th}$ gamma voltage GVx may be substantially identical to those of the $x^{th}$ gamma voltage GVx described above with reference to FIG. 7. The $y^{th}$ gamma reference voltage GRVy and the primitive gamma reference voltage PGRV may vary in substantially the same way as the $x^{th}$ gamma voltage GVx.

Figure 12:
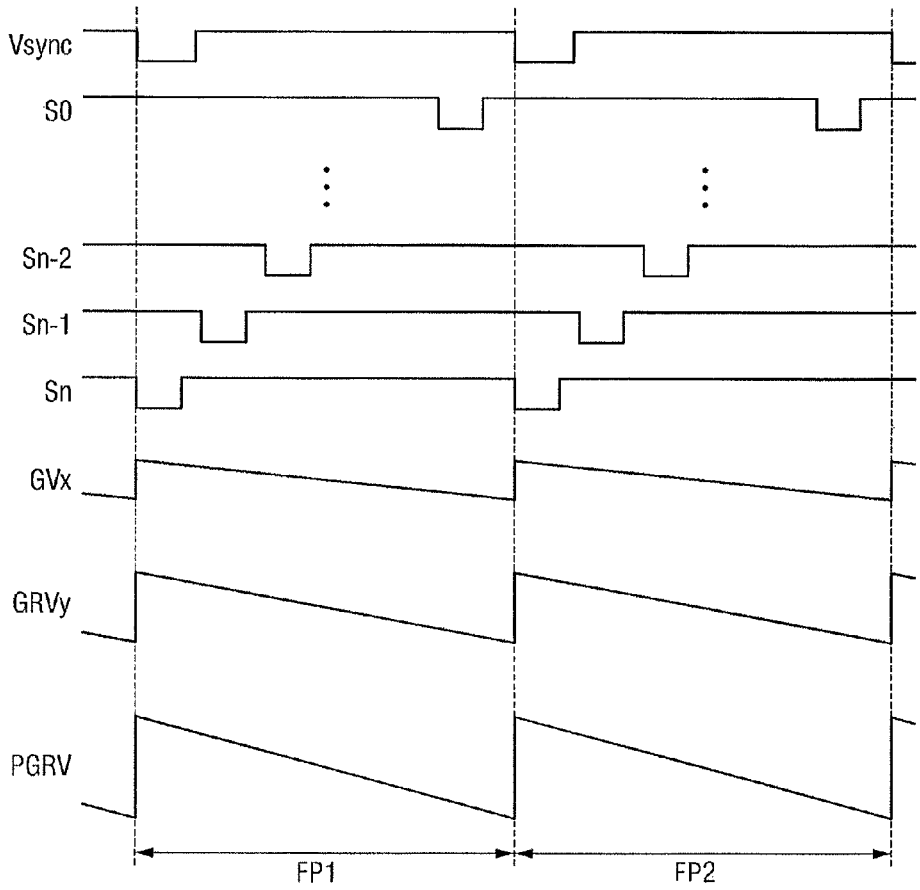
FIG. 12 is a waveform diagram of a vertical synchronization signal, first through $n^{th}$ scan signals, an $x^{th}$ gamma voltage, an $y^{th}$ gamma reference voltage, and a primitive gamma reference voltage according to another embodiment.

Another embodiment will now be described with reference to FIG. 12. FIG. 12 is a waveform diagram of a vertical synchronization signal Vsync, first through $n^{th}$ scan signals S1 through Sn, an $x^{th}$ gamma voltage GVx, an $y^{th}$ gamma reference voltage GRVy, and a primitive gamma reference voltage PGRV according to another embodiment.

Referring to FIG. 12, a description of the vertical synchronization signal Vsync is substantially identical to the description of the vertical synchronization signal Vsync in FIG. 10. The $zero^{th}$ through $n^{th}$ scan signals S0 through Sn may sequentially have the electric potential of the scan-on voltage Vson within one frame of an image displayed on the organic light-emitting display panel 10 in order of the $n^{th}$ scan signal Sn to the $zero^{th}$ scan signal S0. The $n^{th}$ scan signal Sn may change from the scan-off voltage Vsoff to the scan-on voltage Vson at a time when the vertical synchronization signal Vsync changes from a high voltage level to a low voltage level.

The $x^{th}$ gamma voltage GVx may vary in synchronization with the vertical synchronization signal Vsync and vary in the same period as each frame of an image displayed on the organic light-emitting display panel 10. In a first frame period FP1, the $x^{th}$ gamma voltage GVx may decrease continuously. The $x^{th}$ gamma voltage GVx may also decrease continuously in a second frame period FP2. The $x^{th}$ gamma voltage GVx may be controlled to decrease continuously within one frame in synchronization with the vertical synchronization signal Vsync. Therefore, a voltage drop due to the resistance of the first power supply voltage ELVDD can be compensated for, thereby improving display quality. The $y^{th}$ gamma reference voltage GRVy and the primitive gamma reference voltage PGRV may vary in substantially the same way as the $x^{th}$ gamma voltage GVx.

Figure 13:
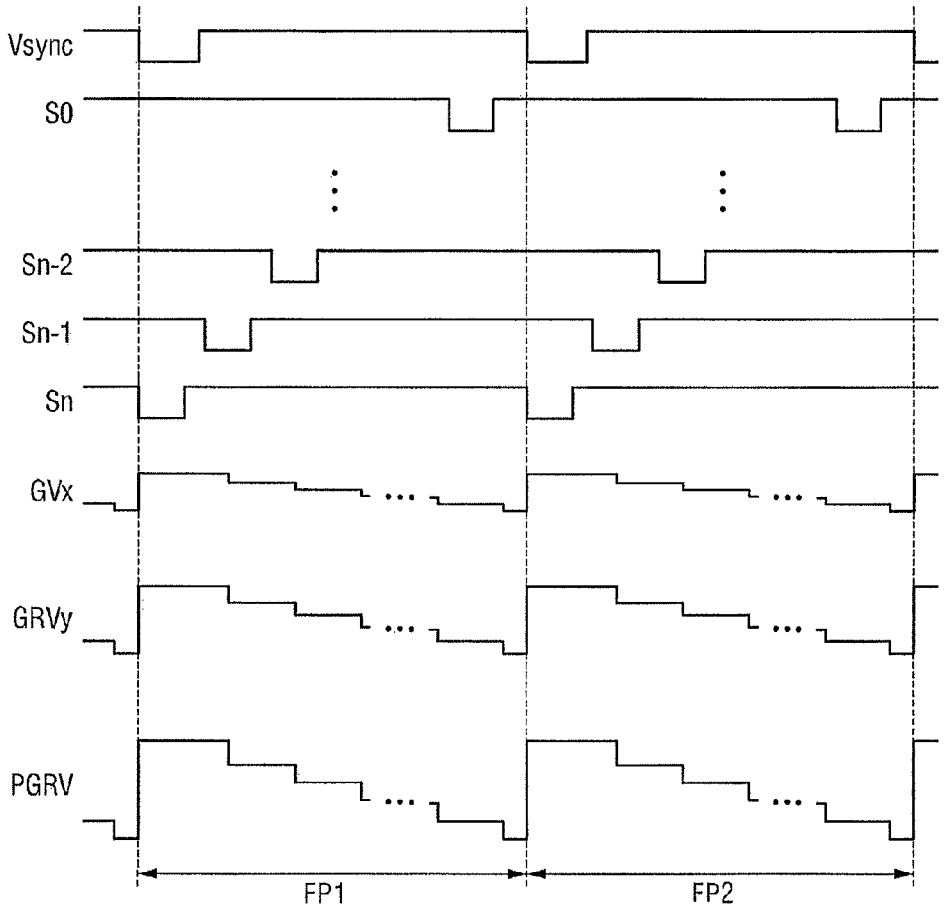
FIG. 13 is a waveform diagram of a vertical synchronization signal, first through $n^{th}$ scan signals, an $x^{th}$ gamma voltage, an $y^{th}$ gamma reference voltage, and a primitive gamma reference voltage according to another embodiment.

Another embodiment will now be described with reference to FIG. 13. FIG. 13 is a waveform diagram of a vertical synchronization signal Vsync, first through $n^{th}$ scan signals S1 through Sn, an $x^{th}$ gamma voltage GVx, an $y^{th}$ gamma reference voltage GRVy, and a primitive gamma reference voltage PGRV according to another embodiment.

Referring to FIG. 13, a description of the vertical synchronization signal Vsync and the $zero^{th}$ through $n^{th}$ scan signals S0 through Sn is substantially identical to the description of the vertical synchronization signal Vsync and the $zero^{th}$ through $n^{th}$ scan signals S0 through Sn in FIG. 12. The $x^{th}$ gamma voltage GVx may vary in synchronization with the vertical synchronization signal Vsync and vary in the same period as each frame of an image displayed on the organic light-emitting display panel 10. The $x^{th}$ gamma voltage GVx may decrease in a stepped manner within one frame. Other features of the $x^{th}$ gamma voltage GVx may be substantially identical to those of the $x^{th}$ gamma voltage GVx described above with reference to FIG. 9. The $y^{th}$ gamma reference voltage GRVy and the primitive gamma reference voltage PGRV may vary in substantially the same way as the $x^{th}$ gamma voltage GVx.

By way of summation and review, to operate the pixels included in an organic light-emitting display panel, the organic light-emitting display device may provide power supply voltages and control signals to the organic light-emitting display panel. The control signals may include scan signals, data signals, emission control signals, and an initialization signal.

If a power supply voltage is provided to the organic light-emitting display panel from a side of the organic light-emitting display panel, the power supply voltage may drop due to internal resistance of wiring within the organic light-emitting display panel. That is, the power supply voltage may have a high value in a region close to the side of the organic light-emitting display panel from which the power supply voltage is provided and may have a low value in a region far away from the side of the organic light-emitting display panel. This difference in the value of the power supply voltage between the regions of the organic light-emitting display panel may cause the regions to display different luminance levels for the same gray level. As a result, display quality may be reduced.

In contrast, embodiments provide an organic light-emitting display device that may compensate for a drop in a power supply voltage due to internal resistance of wiring.

In addition, embodiments provide an organic light-emitting display device that may improve display quality by compensating for luminance non-uniformity of an image resulting from a drop in the power supply voltage due to the internal resistance of the wiring.

Example embodiments have been disclosed herein, and although specific terms are employed, they are used and are to be interpreted in a generic and descriptive sense only and not for purpose of limitation. Accordingly, it will be understood by those of skill in the art that various changes in form and details may be made without departing from the spirit and scope thereof as set forth in the following claims.

What is claimed is:

1. A display device, comprising:

a display panel to display an image;

a data driver to provide a plurality of data signals, which correspond to the image, to the display panel;

a scan driver to sequentially provide a plurality of scan signals to the display panel in synchronization with a vertical synchronization signal, the plurality of scan signals having a gap between adjacent scan signals; and a gamma voltage generator to provide a gamma voltage that varies in synchronization with the vertical synchronization signal, wherein the gamma voltage varies in a stepped manner when the adjacent scan signals are sequentially supplied to the display panel, and wherein a transition point of the gamma voltage is in the gap between the adjacent scan signals.

2. The display device of claim 1, further comprising a power supply providing a first power supply voltage and a second power supply voltage, the second power supply voltage being lower than the first power supply voltage, to the display panel, wherein:

the display panel includes first through m-th scan lines placed parallel to each other and arranged sequentially, and the first power supply voltage is provided to the display panel from a side adjacent to the m-th scan line.

3. The display device of claim 2, wherein the plurality of scan signals are supplied to the first through m-th scan lines, each of the plurality of scan signals having a scan-on section and a scan-off section, and wherein:

the image includes a plurality of frames, the scan-on sections of the plurality of scan signals are applied sequentially to the first through m-th scan lines in order of a scan line located closest to a side from which the first power supply voltage is provided to a scan line located farthest from the side from which the first power supply voltage is provided, and the gamma voltage gradually decreases within one period of the frames.

4. The display device of claim 2, wherein the plurality of scan signals are supplied to the first through m-th scan lines, each of the plurality of scan signals having a scan-on section and a scan-off section, and wherein:

the image includes a plurality of frames, the scan-on sections of the plurality of scan signals are applied sequentially to the first through m-th scan lines in order of a scan line located farthest from a side from which the first power supply voltage is provided to a scan line located closest to the side from which the first power supply voltage is provided, and the gamma voltage gradually increases within one period of the frames.

5. The display device of claim 1, wherein the gamma voltage generator includes:

a gamma reference voltage generator generating a gamma reference voltage that varies in synchronization with the vertical synchronization signal, and a gamma voltage divider generating the gamma voltage from the gamma reference voltage.

6. The display device of claim 5, wherein the gamma reference voltage generator generates the gamma reference voltage from a primitive gamma reference voltage that varies in synchronization with the vertical synchronization signal.

7. The display device of claim 6, wherein the gamma reference voltage includes first through k-th gamma reference voltages arranged in order of highest to lowest electric potential, wherein the primitive gamma reference voltage has a same electric potential as the first gamma reference voltage.

8. The display device of claim 7, wherein the image includes a plurality of frames, wherein the gamma voltage varies continuously within one period of the frames.

9. The display device of claim 7, wherein the image includes a plurality of frames, wherein the gamma voltage varies in the stepped manner within one period of the frames.

10. The display device of claim 9, wherein each of the plurality of scan signals includes a scan-on section and a scan-off section, and wherein the gamma voltage does not vary in the scan-on section.

* * * * *